US008165872B2

(12) United States Patent
LeBlanc et al.

(10) Patent No.: US 8,165,872 B2
(45) Date of Patent: Apr. 24, 2012

(54) METHOD AND SYSTEM FOR IMPROVING SPEECH QUALITY

(75) Inventors: Wilfrid LeBlanc, Vancouver (CA); Mohammad Zad-Issa, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 901 days.

(21) Appl. No.: 11/670,154

(22) Filed: Feb. 1, 2007

(65) Prior Publication Data

US 2008/0189100 A1 Aug. 7, 2008

(51) Int. Cl.
*G10L 11/04* (2006.01)

(52) U.S. Cl. ..... 704/207; 704/200; 704/223

(58) Field of Classification Search ..... 704/200, 704/203, 205, 226, 215, 214, 207, 223, 201, 704/209, 220; 714/746
See application file for complete search history.

(56) References Cited

U.S. PATENT DOCUMENTS 7,356,748 B2 * 4/2008 Taleb ..... 714/746
* cited by examiner

*Primary Examiner* — Huyen X. Vo
(74) *Attorney, Agent, or Firm* — Thomas, Kayden, Horstemeyer & Risley, LLP

(57) ABSTRACT

A method and system for improving speech quality may include estimating at least one component of a distorted portion of a speech signal from at least one component of an undistorted portion of the speech signal and reinforcing the component of the distorted portion based on the estimating. The components may include the pitch, spectral envelope and spectral energy of the speech signal. The undistorted portion of the speech signal may be delayed and the components of the distorted portion may be interpolated from the components of a delayed undistorted portion and a current undistorted portion of the speech signal. The components of the distorted portion of the speech signal may be extrapolated from a current undistorted portion of the speech signal. Components of the distorted portion of the speech signal may be estimated from frequency bands other than the frequency band affected by the distortion.

24 Claims, 8 Drawing Sheets

METHOD AND SYSTEM FOR IMPROVING SPEECH QUALITY

CROSS-REFERENCE TO RELATED APPLICATIONS/INCORPORATION BY REFERENCE

Not Applicable.

FIELD OF THE INVENTION

Certain embodiments of the invention relate to speech communication. More specifically, certain embodiments of the invention relate to a method and system for improving speech quality.

BACKGROUND OF THE INVENTION

As competition in the mobile device business has increased, manufacturers of mobile devices may have found themselves struggling to differentiate their respective products. Although mobile device styling may have been the preferred way of attracting consumers, manufactures are increasingly turning to adding additional features to increase market share. For example, many cellular telephones run familiar applications such as email applications, calendars, and other personal information management type software. Some may also include speakerphone capabilities, which may enable, for example, a cellular telephone to be utilized as a conference call phone. In addition, some cellular telephones may include hardware and software to support hands-free capability. For example, the phone may be capable of working with a Bluetooth headsets, which may free up the hands of the user.

To improve speech quality, some cellular telephones may include a wind noise filter. These may be needed when the user of a cellular phone is, for example, operating the phone under windy conditions. This may be particularly useful when the speaker-phone and hands free capabilities described above are utilized. Wind noise filters may attenuate the effects of the wind noise by, for example, dynamically activating a filter that may attenuate those frequencies commonly associated with wind noise, such as frequencies below 800 Hz.

In the process, however, application of a wind noise filter may attenuate necessary speech components because the filter may not be capable of discerning between normal speech and wind noise in those frequency regions. The result of this may be that a listener may have difficulty understanding the speaker. This problem may be exacerbated because the wind noise filter may be turning on and off frequently, thus resulting in a less than pleasing communication experience.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A system and/or method is provided for improving speech quality, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Certain embodiments of the invention may be found in a method and system for improving speech quality. The method may include estimating at least one component of a distorted portion of a speech signal from at least one component of an undistorted portion of the speech signal and reinforcing the component of the distorted portion based on the estimating. The components may include the pitch, spectral envelope and spectral energy of the speech signal. The method may also include delaying the undistorted portion of the speech signal and interpolating the components of the distorted portion of the speech signal from the components of a delayed undistorted portion and a current undistorted portion of the speech signal. The components of the distorted portion of the speech signal may be extrapolated from a current undistorted portion of the speech signal. The method may also include estimating the components of the distorted portion of the speech signal from frequency bands other than the frequency band effected by the distortion.

Figure 1:
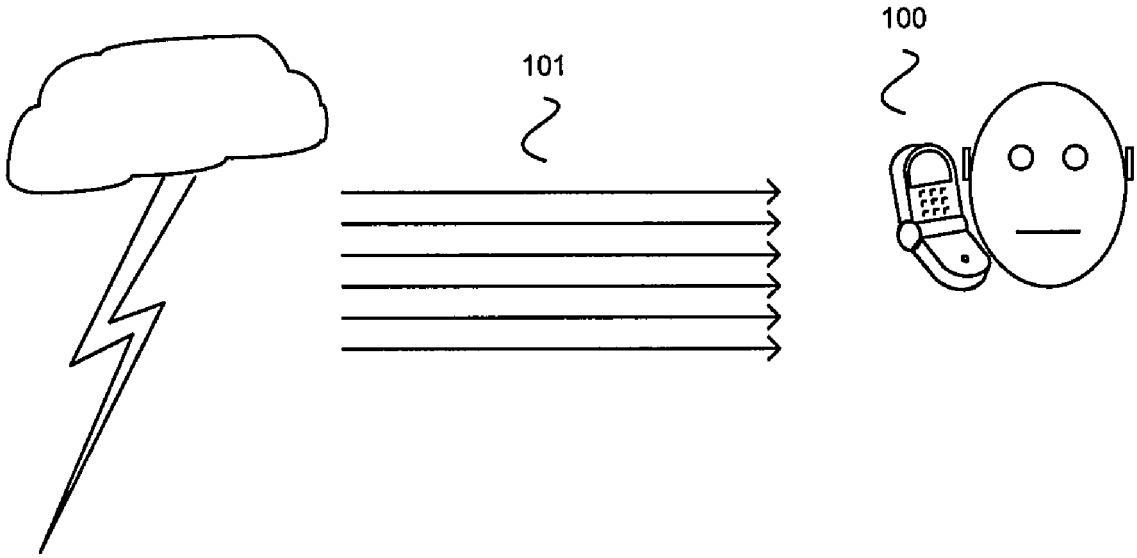
FIG. 1 is a block diagram of exemplary wind noise interfering with speech communication, in connection with an embodiment of the invention.

FIG. 1 is a block diagram of exemplary wind noise interfering with speech communication, in connection with an embodiment of the invention. Referring to FIG. 1, there is shown a mobile device 100 and wind noise 101. In a windy environment, the noise generated by the wind may obscure the speech from the user. The wind noise 101 may be the result of wind pressure fluctuations that occur near a microphone in the mobile device 100. It may be shown that the wind noise 101 predominately-affects frequency below 800 Hz. It may also be shown that the wind noise 101 may be an additive type of noise. That is, the output of the microphone within a mobile device 100 may produce the sum of the wind noise 101 and the users speech. Therefore, when the relative amplitude of the wind noise 101 is, for example, large with respect to the user's speech, the speech may be less intelligible to a listener of the speech. To compensate for the effects of the wind noise 101, for example, the mobile device 100 may comprise, for example, a wind noise filter. The filter may be a high pass filter capable of attenuating those frequency components of the microphone output signal that occur below 800 Hz. This may also attenuate those components of the speech that fall below 800 Hz as well and may therefore impede communication with another user.

Figure 2A:
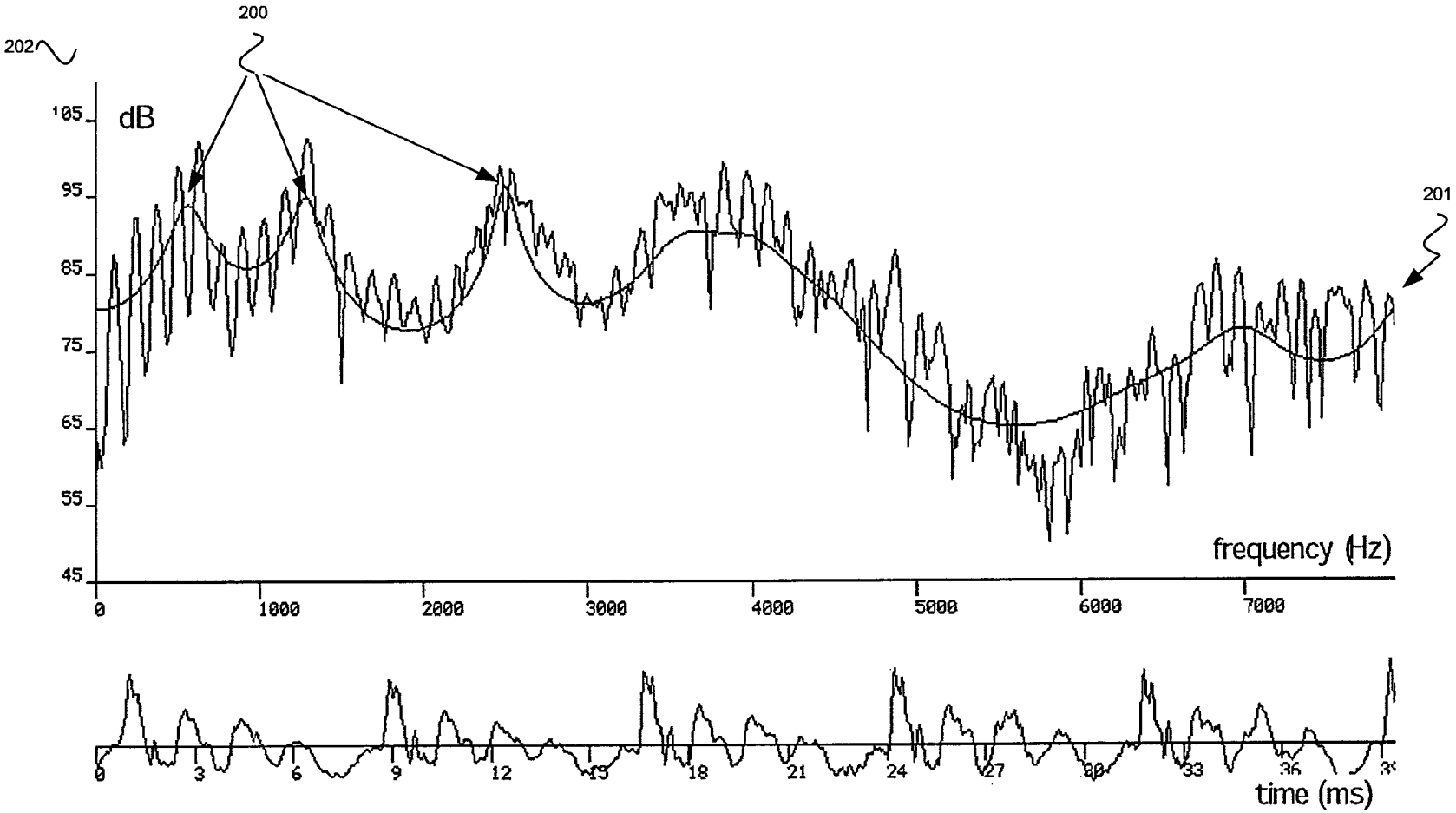
FIG. 2A is a diagram of an exemplary graph of the spectral envelope of a voiced signal, in connection with an embodiment of the invention.

FIG. 2A is a diagram of an exemplary graph of the spectral envelope of a voiced signal, in connection with an embodiment of the invention. Referring to FIG. 2A, there is shown a spectral envelope 201, several voiced formants 200, and a voiced region of a signal 202. The voiced region of the signal 202 may represent, for example, a 40 ms time slice of a signal where speech is present. The spectral envelope 201 may represent the frequency characteristics present in the voiced time slice 202. The spectral envelope 201 may be computed, for example, by performing the FFT function on the voiced time slice 202. The spectral envelope 201 may be treated as a probability density function that is, for example, a mixture of Gaussian waveforms. In other words, the peaks of the spectral envelope 201 may represent signal frequencies that have a higher probability of occurring. The higher the peak, for example, the more likely there may be frequencies present at that location. The voiced formants 200 may correspond to the peaks in the spectral envelope 201. In this regard, the voiced formants 200 may be the distinguishing or meaningful frequency components of human speech. For example, the voiced formants 200 may represent the characteristic partials that identify vowels to a listener. For example, it may be shown that vowels may have four or more distinguishable voiced formants 200. In this regard, a vowel may be detected, for example, by counting the number of voiced formants 200 in the signal.

Figure 2B:
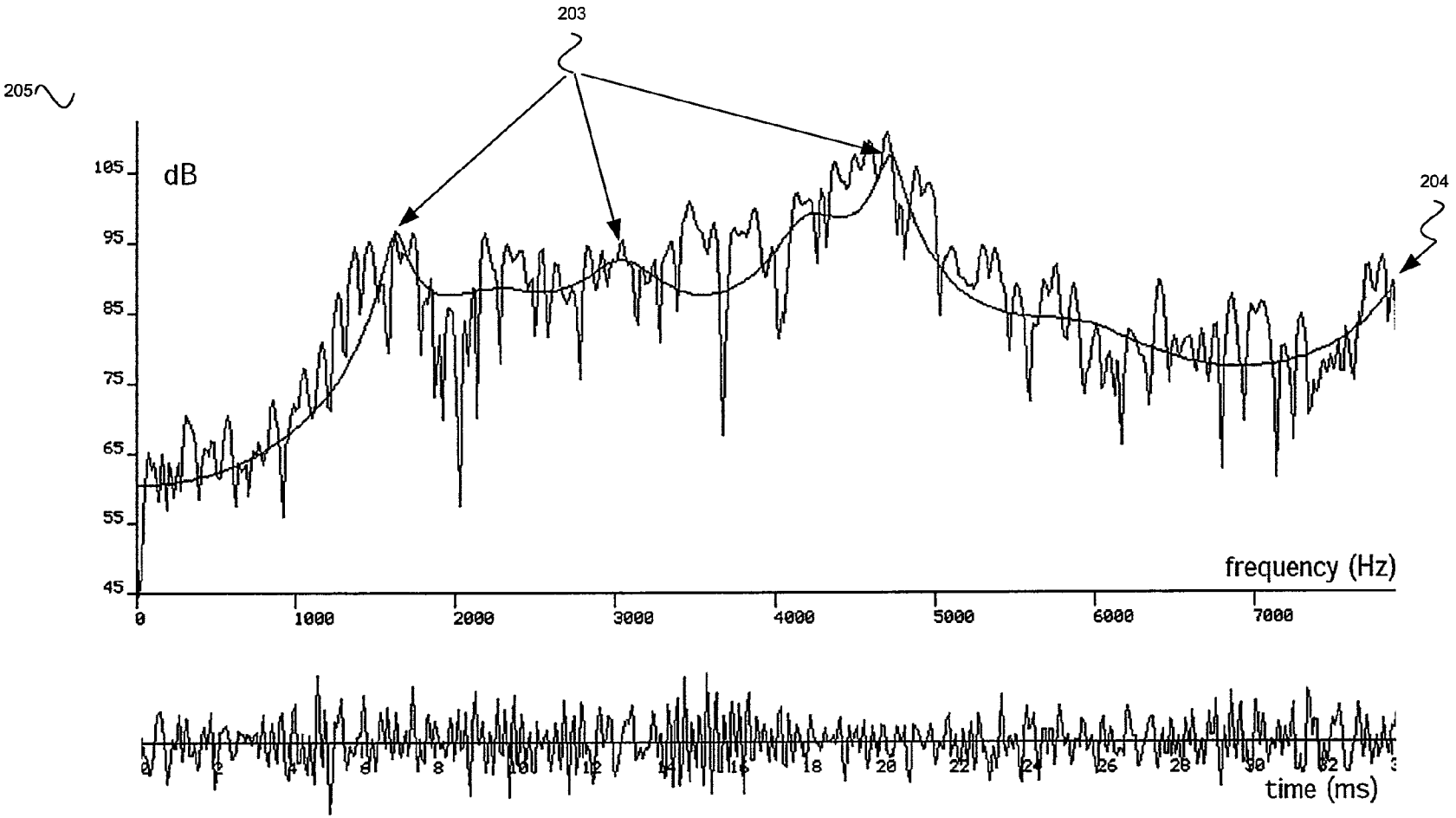
FIG. 2B is a diagram of an exemplary graph of the spectral envelope of an unvoiced signal, in connection with an embodiment of the invention.

FIG. 2B is a diagram of an exemplary graph of the spectral envelope of an unvoiced signal, in connection with an embodiment of the invention. Referring to FIG. 2B, there is shown an unvoiced spectral envelope 204, several unvoiced formants 203, and an unvoiced region of a signal 205. The unvoiced region of the signal 205 may represent, for example, a 40 ms time slice of a signal where no speech is present. The unvoiced spectral envelope 204 may represent the frequency characteristics present in the unvoiced time slice 205. The unvoiced spectral envelope 204 may be computed as described in FIG. 2A above. The unvoiced formants 203 may be distinguished from the voice formants 200 in that the relative amplitude of the peaks may not be as distinct from one another as compared to the voice formants 200. This phenomenon may be exploited by a speech processor. For example, a speech processor may utilize this information to determine whether speech exists in a given signal. The speech processor may then, for example, encode the signal at a higher bit rate for voiced regions of the signal 202 and use a lower encoder bit rate for unvoiced regions of the signal 205.

Figure 3A:
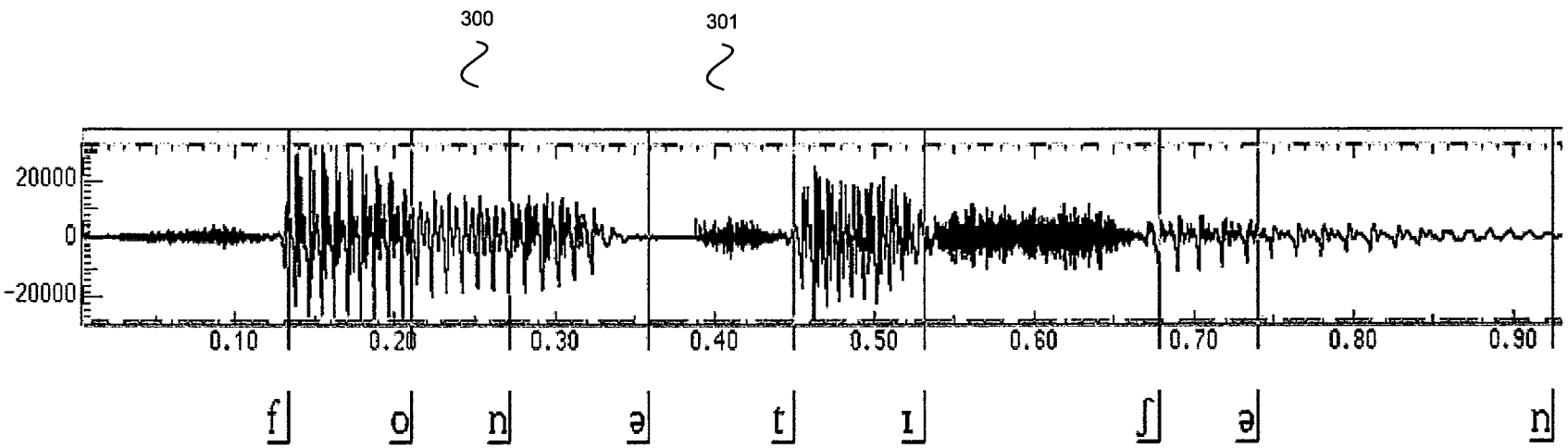
FIG. 3A is an exemplary graph of a waveform depicting a speech utterance corresponding to the word "phonetician" as spoken by a male adult, in connection with an embodiment of the invention.

FIG. 3A is an exemplary graph of a waveform depicting a speech utterance corresponding to the word "phonetician" as spoken by a male adult, in connection with an embodiment of the invention. Referring to FIG. 3A, there is shown a voiced portion of the speech utterance 300 and an un-voiced portion of the speech utterance 301. It may be shown that physically the speech signal may be a series of pressure changes in the medium between the sound source and the listener. The time axis may be the horizontal axis from left to right and the curve may show how the pressure increases and decreases in the signal.

Figure 3B:
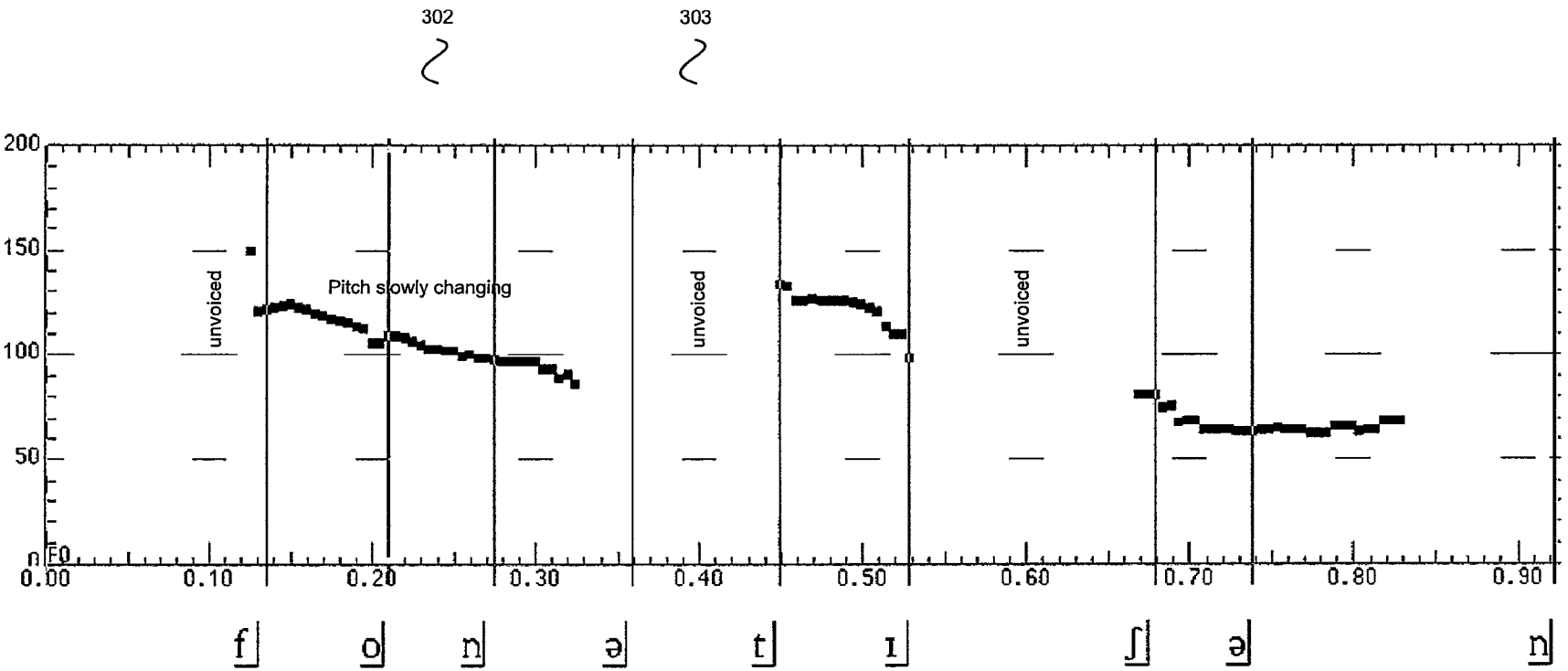
FIG. 3B is an exemplary graph depicting the pitch of a speech utterance, in connection with an embodiment of the invention.

FIG. 3B is an exemplary graph depicting the pitch of a speech utterance, in connection with an embodiment of the invention. Referring to FIG. 3B, there is shown a voiced portion of the pitch 302 and an unvoiced portion of the pitch 303. The graph may represent the pitch of the speech utterance referred to in FIG. 3A. Speech may be looked upon as a physical process consisting of two parts: a product of a sound source (the vocal chords) and filtering by, for example, the tongue, lips, and teeth. Pitch analysis may try to capture the fundamental frequency of the sound source by analyzing the final speech utterance. The fundamental frequency may be the dominating frequency of the sound produced by the vocal chords. The fundamental frequency may be the part of the speech signal that a listener utilizes to perceive the speakers' intonation and stress.

Figure 3C:
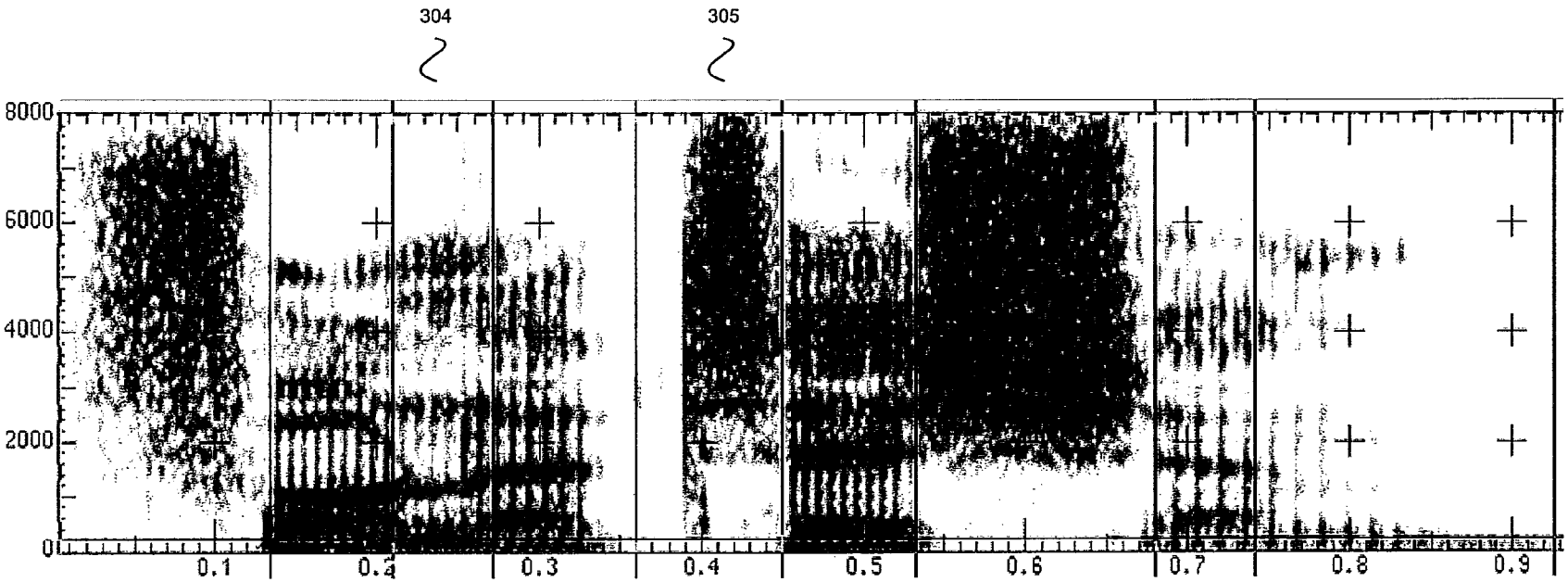
FIG. 3C is an exemplary graph depicting the spectrogram of a speech utterance, in connection with an embodiment of the invention.

FIG. 3C is an exemplary, graph depicting the spectrogram of a speech signal, in connection with an embodiment of the invention. Referring to FIG. 3C there is shown a voiced portion of the spectrogram 304 and an unvoiced portion of the spectrogram 305. In the spectrogram the time axis may be the horizontal axis, and frequency may be the vertical axis. The third dimension, amplitude, may be represented by shades of darkness. The spectrogram may be viewed as a number of spectral envelopes 201 and 204 in a row, looked upon from above, where the highs in the spectral envelopes 201 and 204 are represented with dark spots in the spectrogram. Referring to the voiced portion of the spectrogram 304, vertical lines may represent, for example, the spectral envelope of the voiced portion of the speech utterance 300. In this regard, the formants described in FIG. 2A may be seen as the dark, generally horizontal bands in the voiced portion of the spectrogram 304. Referring to the unvoiced portion of the spectrogram 305, the formants for the un-voiced portion of the speech utterance 301 may not be readily visible. Rather this portion may appear more like noise.

Figure 4:
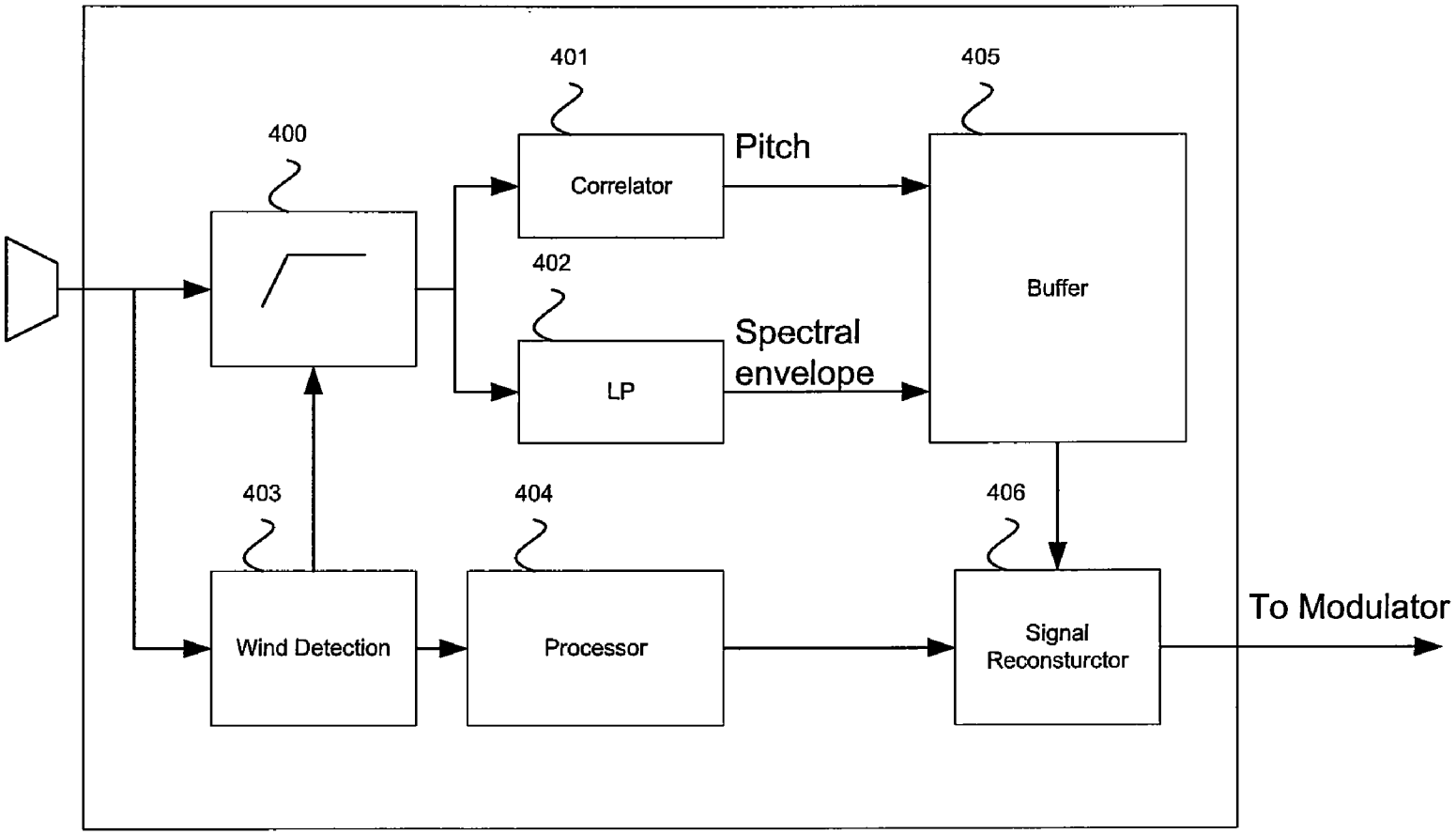
FIG. 4 is a block diagram of an exemplary system for compensating speech in the presence of wind noise, in accordance with an embodiment of the invention.

FIG. 4 is a block diagram of an exemplary system for compensating speech in the presence of wind noise, in accordance with an embodiment of the invention. Referring to FIG. 4, there is shown a high pass filter 400, a correlator 401, a linear predictor 402, a buffer 405, a wind detector 403, a processor 404, and a signal reconstructor 406. The processor 404 may comprise suitable logic, circuitry, and/or code that may enable the activation of several processes when wind noise 101 may be detected. In this regard, the wind detector 403 may notify the processor when wind may be present in the input signal. The processor 404 may be programmed to react differently depending on the amount of wind noise 101 detected. For example, the processor 404 may be programmed to react to wind noise 101 detected that may be above a threshold. When this happens, the processor 404 may activate the high pass filter 400, which may remove those components in the input signal related to the wind noise 101. The processor 404 may also enable the signal reconstructor 406 when wind noise 101 may have been detected.

The buffer 405 may comprise suitable logic, circuitry, and/or code that may enable the storage of pitch and spectral envelope samples of the input' signal. In this regard, the buffer 405 may be capable of storing, for example, 10 ms, 15 ms, or 40 ms worth of samples. The samples may be utilized by the signal reconstructor 406 to reconstruct those parts of the input signal affected by wind noise 101.

The wind detector 403 may comprise suitable logic, circuitry, and/or code that may enable detection of wind noise 101 interference produced at a microphone. It may be shown that wind noise 101 may occur in the lower end of the audible frequency spectrum. For example, the wind noise 101 may be present in frequencies below 800 Hz. In this regard, the wind noise 101 may distort those voice signal frequencies below 800 Hz. The wind detector 403 may detect the presence of wind noise 101 by observing sudden changes to the audio spectrum below 800 Hz. For example, it may be shown that changes in the voice spectrum may occur at frequencies above 800 Hz as well as below 800 Hz. By observing a situation where the lower part of the spectrum changes without the upper part of the spectrum changing, the wind detector 403 may detect the presence of wind noise 101 in the voice spectrum.

The high pass filter 400 may comprise suitable logic, circuitry, and/or code that may enable the removal of noise associated with wind noise 101. As described above, wind noise 101 may be predominately present in the lower part of the audio spectrum. For example, it may occur at frequencies below 800 Hz. In this case, the high pass filter 400 may attenuate those frequencies below 800 Hz and allow frequencies above 800 Hz to pass without attenuation.

The correlator 401 may comprise suitable logic, circuitry, and/or code that may enable the detection of the pitch of the input signal. In this regard, the correlator 401 may detect the pitch, as shown in FIG. 3B, of the speech signal shown in FIG. 3A, by computing the autocorrelation of the speech signal. The autocorrelation of the input signal may be represented by the following equation:

$$R(j) = -\sum_{n} (x_n)(x_{n-j}^*)$$

where $x_n$ is the input signal. The pitch samples detected may be stored to the buffer 405.

The linear predictor 402 may comprise suitable logic, circuitry, and/or code that may enable detection of the spectral envelope of the input signal. The linear predictor may estimate future samples as a linear function of previous samples. In this regard, the function performed by the linear predictor 402 may be represented by the following equation:

$$\hat{s}_n = -\sum_{i=1}^{P} a_i s_{n-i}$$

where $\hat{s}_n$ is the predicted sample, $s_{n-i}$ is the previous observed sample, and $a_i$ are the predictor coefficients. The transfer function H(z) of this function may correspond to the spectral envelope shown in FIG. 2A and FIG. 2B and may be represented by the following equation:

$$H(z) = \frac{1}{1 - \sum_{i=1}^{p} a_i z^{-i}}$$

The linear predictor may utilize the above functions to compute the spectral envelope of a time slice of a signal and may then store the spectral envelope to the buffer 405. In this regard, the time slices of the spectral envelope may be represented by the spectrogram described in FIG. 3C above.

The signal reconstructor 406 may comprise suitable logic, circuitry, and/or code that may enable the interpolation and reconstruction of the signal when the wind filter may be enabled. In this regard, the signal reconstructor 406 may be activated when the processor 404 has, for example, detected wind noise 101 above a certain threshold or when there has been an abrupt change in the pitch, spectral envelope or spectral energy of the input signal. In this case, the signal reconstructor 406 may utilize samples of the pitch information that occurred before and after the signal in question as well as samples of the spectral envelope of the signal before and after the detection to interpolate for the effects of the wind noise 101.

Figure 5:
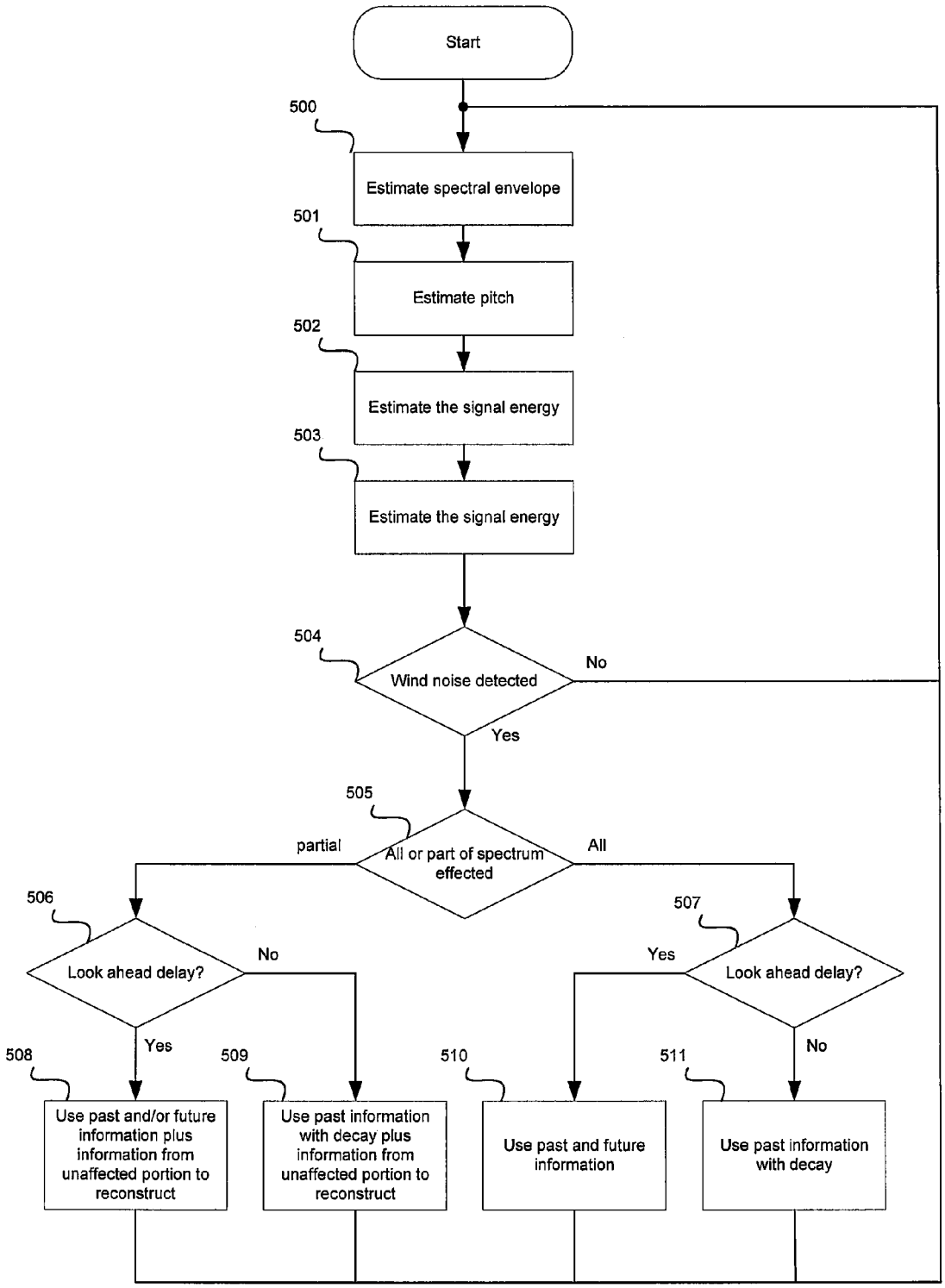
FIG. 5 is a block diagram of an exemplary flow chart for compensating a speech signal, in accordance with an embodiment of the invention.

FIG. 5 is a block diagram of an exemplary flow chart for tracking the characteristics of a signal, in accordance with an embodiment of the invention. Referring to FIG. 5, at step 500, the spectral envelope 201 and 204 of the signal may be estimated. For example, the linear predictor 402 may be utilized to estimate the spectral envelope 201 and 204 of the input signal for time slices of the input signal. The time slices may, for example, be 10 ms, 15 ms, or 20 ms. The spectral envelope 201 and 204 samples may then be stored to a buffer 405. At step 501, the pitch of the input signal may be estimated. For example, the correlator 401 may be utilized to perform the autocorrelation function on the input signal. This may occur, for example, every 5 ms and the result may be stored to the buffer 405.

At step 502, the estimate of the signal energy may be computed as a function of time and/or frequency. This result may be stored to the buffer 405. At step 503, the random noise like component of the speech signal may be computed, for example, every 5 ms and this may be stored to the buffer 405 as well. At step 504, a determination may be made as to whether there has been an abrupt change in the pitch, spectral envelope or spectral energy of the input signal. This may occur, for example, when the high pass filter 400 has been activated. If no change in, for example, the pitch, spectral envelope or spectral energy is detected, the process may go back to step 500 and repeat. If a change in for example, the pitch, spectral envelope or spectral energy has been detected, then at step 505, a determination may be made as to whether all or part of the speech signal is affected by the wind noise 101. This may be accomplished, for example, by comparing the spectral envelope 201 and 204 of the signal before and after the abrupt change.

If only part of the spectrum is affected, then at step 506 a determination may be made as to whether the system has look ahead delay. That is, whether past and future samples of the speech signal are stored in the buffer 405. If look ahead delay is supported, then at step 508, the reconstructor 406 may compensate for the effects of the wind noise 101 by utilizing the information from the unaffected bands as well as the parameters stored in the buffer 405 representing past and/or future parameters of the speech signal that were not affected by the wind noise 101. For example, the pitch, spectral envelope, and signal energy estimates stored in the buffer 405, along with information about the unaffected portion of the speech signal may be utilized to reconstruct the pitch, formants, and spectral envelope of the affected area of the signal. Alternatively, the signal may be compensated by interpolating the frequency spectrum between past and future speech samples or by utilizing an interpolative packet loss concealment method, which may be utilized to mask the effects of lost or discarded packets. In other words, rather than correct the distorted portion of the speech, the previous undistorted portion of the speech may, for example, be repeated.

Referring back to step 506, if look ahead delay is not supported, then at step 509, the reconstructor 406 may compensate for the effects of the wind noise 101 by utilizing the information from the unaffected bands as well as the parameters stored in the buffer 405 representing past parameters of the speech signal that were not affected by the wind noise 101. In this regard, it may be necessary to decay the signal level gracefully. Alternatively, the signal may be compensated by utilizing an interpolative packet loss concealment method as described above.

Referring back to step 505, if the entire spectrum is affected, then at step 507, a determination may be made as to whether the system has look ahead delay. If look ahead delay is supported, then at step 510, the reconstructor 406 may compensate for the effects of the wind noise 101 by utilizing the parameters stored in the buffer 405 representing past and future parameters of the speech signal that were not affected by the wind noise 101. For example, the pitch, spectral envelope, and signal energy estimates stored in the buffer 405 may be utilized to reconstruct the pitch, formants, and spectral envelope of the entire signal. Alternatively, the signal may be compensated by interpolating the frequency spectrum between past and future speech samples or by utilizing an interpolative packet loss concealment method as described above.

Referring back to step 507, if look ahead delay is not supported, then at step 511, the reconstructor 406 may compensate for the effects of the wind noise 101 by utilizing the parameters stored in the buffer 405 representing past parameters of the speech signal that were not affected by the wind noise 101. In this regard, it-may be necessary to decay the signal level gracefully. Alternatively, the signal may be compensated by utilizing an interpolative packet loss concealment method as described above.

In another embodiment of the invention, the steps described herein may be performed in different domains. For example, the speech parameters may be characterized as a frequency domain representation, a prototype waveform representation, or a perceptual domain representation.

Another embodiment of the invention may provide a method for performing the steps as described herein for improving speech quality. For example, the system shown in FIG. 4 may be configured to estimate at least one component of a distorted portion of a speech signal from at least one component of an undistorted portion of the speech signal by utilizing a correlator 401 and linear predictor 402 and may reinforce the component of the distorted portion based on the estimating by utilizing a signal reconstructor 406. The components may include the pitch, spectral envelope and spectral energy of the speech signal. The method may also include delaying the undistorted portion of the speech signal by utilizing a buffer 405 and interpolating the components of the distorted portion of the speech signal from the components of a delayed undistorted portion and a current undistorted portion of the speech signal. In another aspect of the invention, the components of the distorted portion of the speech signal may be extrapolated from a current undistorted portion of the speech signal. In this regard, no future information may be utilized and no delay may be introduced. The method may also include estimating the components of the distorted portion of the speech signal from frequency bands other than the frequency band effected by the distortion.

In accordance with another embodiment of the invention, a method for processing signals may comprise replacing a frequency component that matches a background noise estimate of a speech signal with an estimate derived from a signal that is characteristic of the background noise estimate. The background noise estimate of the speech signal may comprise a long-term background noise estimate. The signal that is characteristic of the background noise estimate may comprise a frequency component that is derived from a history of background noise estimates. In other words, the background noise estimate may be derived from prior background noise estimates. The signal background noise estimate of the speech signal may comprise comfort noise. One aspect of the invention may comprise detecting when at least a portion of the speech signal is distorted. Accordingly, based on the detection, replacement of the frequency component that matches a background noise estimate and/or reinforcement of one or more components of the distorted portion of the speech based on the estimating may occur.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method for processing signals, the method comprising:

estimating, by a predictor, at least one component of a distorted portion of a generated speech spectral envelope signal generated for transmission over a communication network to a remotely located receiver, said estimating comprising utilizing at least one component from an undistorted portion of said generated speech spectral envelope signal;

adjusting, by a signal reconstructor, said at least one component of said distorted portion of said generated speech spectral envelope signal based on said estimating; and transmitting, by a transmitter, said reinforced generated speech spectral signal over a communication network to the remotely located receiver.

2. The method according to claim 1, comprising extrapolating said at least one component of said distorted portion of said generated speech spectral envelope signal from a current undistorted portion of said generated speech spectral envelope signal.

3. The method according to claim 1, comprising delaying said undistorted portion of said generated speech spectral envelope signal.

4. The method according to claim 3, comprising interpolating said at least one component of said distorted portion of said generated speech spectral envelope signal from said delayed undistorted portion of said generated speech spectral envelope signal and a current undistorted portion of said generated speech spectral envelope signal.

5. The method according to claim 1, wherein said distorted portion of said generated speech spectral envelope signal occurs in a first frequency band of a plurality of frequency bands of said generated speech spectral envelope signal.

6. The method according to claim 5, comprising estimating at least one component of said distorted portion of said generated speech spectral envelope signal from frequency bands other than said first frequency band.

7. The method according to claim 1, wherein said estimated at least one component is one or more of a pitch component, a spectral envelope component, and/or a spectral energy component.

8. The method according to claim 1, wherein said reinforced at least one component is one or more of a pitch component, a spectral envelope component, and/or a spectral energy component.

9. A non-transitory computer-readable medium having stored thereon, a computer program having at least one code section for processing signals, the at least one code section being executable by a computer for causing the computer to perform steps comprising:

estimating, by a predictor, at least one component of a distorted portion of a generated speech spectral envelope signal generated for transmission over a communication network to a remotely located receiver, said estimating comprising utilizing at least one component from an undistorted portion of said generated speech spectral envelope signal;

reinforcing, by a signal reconstructor, said at least one component of said distorted portion of said generated speech spectral envelope signal based on said estimating; and transmitting, by a transmitter, said reinforced generated speech spectral signal over a communication network to the remotely located receiver.

10. The non-transitory computer-readable medium according to claim 9, wherein said at least one code section comprises code that enables extrapolating said at least one component of said distorted portion of said generated speech spectral envelope signal from a current undistorted portion of said generated speech spectral envelope signal.

11. The non-transitory computer-readable medium according to claim 9, wherein said at least one code section comprises code that enables delaying said undistorted portion of said generated speech spectral envelope signal.

12. The non-transitory computer-readable medium according to claim 11, wherein said at least one code section comprises code that enables interpolating said at least one component of said distorted portion of said generated speech spectral envelope signal from said delayed undistorted portion of said generated speech spectral envelope signal and a current undistorted portion of said generated speech spectral envelope signal.

13. The non-transitory computer-readable medium according to claim 9, wherein said distorted portion of said generated speech spectral envelope signal occurs in a first frequency band of a plurality of frequency bands of said generated speech spectral envelope signal.

14. The non-transitory computer-readable medium according to claim 13, wherein said at least one code section comprises code that enables estimating at least one component of said distorted portion of said generated speech spectral envelope signal from frequency bands other than said first frequency band.

15. The non-transitory computer-readable medium according to claim 9, wherein said estimated at least one component is one or more of a pitch component, a spectral envelope component, and/or a spectral energy component.

16. The non-transitory computer-readable medium according to claim 9, wherein said reinforced at least one component is one or more of a pitch component, a spectral envelope component, and/or a spectral energy component.

17. A system for processing signals, the system comprising:

one or more circuits that enables estimating by a predictor, at least one component of a distorted portion of a generated speech spectral envelope signal generated for transmission over a communication network to a remotely located receiver, said estimating comprising utilizing at least one component from an undistorted portion of said generated speech spectral envelope signal;

said one or more circuits enables reinforcing by a signal reconstructor, said at least one component of said distorted portion of said generated speech spectral envelope signal based on said estimating; and transmitting by a transmitter, said reinforced generated speech spectral signal over a communication network to the remotely located receiver.

18. The system according to claim 17, wherein said one or more circuits enables extrapolating said at least one component of said distorted portion of said generated speech spectral envelope signal from a current undistorted portion of said generated speech spectral envelope signal.

19. The system according to claim 17, wherein said one or more circuits enables delaying said undistorted portion of said generated speech spectral envelope signal.

20. The system according to claim 19, wherein said one or more circuits enables interpolating said at least one component of said distorted portion of said generated speech spectral envelope signal from said delayed undistorted portion and a current undistorted portion of said generated speech spectral envelope signal.

21. The system according to claim 17, wherein said distorted portion of said generated speech spectral envelope signal occurs in a first frequency band of a plurality of frequency bands of said generated speech spectral envelope signal.

22. The system according to claim 21, wherein said one or more circuits enables estimating at least one component of said distorted portion of said generated speech spectral envelope signal from frequency bands other than said first frequency band.

23. The system according to claim 17, wherein said estimated at least one component is one or more of a pitch component, a spectral envelope component, and/or a spectral energy component.

24. The system according to claim 17, wherein said reinforced at least one component is one or more of a pitch component, a spectral envelope component, and/or a spectral energy component.

* * * * *